United States Patent [19]

Bogner

[11] 3,975,733

[45] Aug. 17, 1976

[54] TRANSMITTING ANTENNA EMPLOYING RADIAL FINS

[76] Inventor: Richard D. Bogner, 4 Hunters Lane, Roslyn, N.Y. 11576

[22] Filed: Nov. 22, 1974

[21] Appl. No.: 526,339

[52] U.S. Cl. ..... 343/770; 343/833; 343/836; 343/891

[51] Int. Cl.[2] ..... H01Q 15/14; H01Q 19/14

[58] Field of Search ..... 343/833, 834, 835, 836, 343/837, 890, 891, 770

[56] References Cited

UNITED STATES PATENTS

| | | | |
|---|---|---|---|
| 2,510,290 | 6/1950 | Masters | 343/767 |
| 3,218,646 | 11/1965 | Ehrenspeck | 343/819 |
| 3,438,043 | 4/1969 | Ehrenspeck | 343/819 |
| 3,555,552 | 1/1971 | Alford | 343/890 |
| 3,587,108 | 6/1971 | Bogner | 343/833 |
| 3,829,864 | 8/1974 | Truskanov et al. | 343/890 |

*Primary Examiner*—Eli Lieberman

*Attorney, Agent, or Firm*—Bauer, Amer & King

[57] ABSTRACT

A transmitting antenna assembly comprises elementary driven antenna elements and generally radially extending fins mounted on a conventional supporting structure to obtain an omnidirectional or other desired antenna pattern, even for supporting structures of relatively large transverse dimensions.

13 Claims, 22 Drawing Figures

TRANSMITTING ANTENNA EMPLOYING RADIAL FINS

BACKGROUND OF THE INVENTION

The present invention relates to antennas employing generally radially extending metal fins and more particularly to such antennas for television broadcasting.

In the design of transmitting antennas for television broadcasting, and especially for high VHF-TV frequencies (e.g., 174–216 mHz) and for UHF-TV frequencies (e.g., 470 mHz. to 890 mHz.), it is generally desired to achieve high gain with an omnidirectional pattern (or a pattern of some other desired shape) in the azimuth plane at minimum cost. For omnidirectional performance, the total or maximum signal strength variation as a function of azimuth plane direction cannot be more than approximately 3db (± 1.5db) in accordance with trade acceptance and FCC standards, and such an antenna pattern is very often required by a broadcasting station providing service to a given region or community.

To achieve a high overall antenna gain, it is the usual practice to vertically stack a large number of driven antenna elements, each one defining a "bay", to typically provide a vertical array extending for 20 to 50 feet, or more. In view of the substantial vertical height thus needed, the supporting structure, typically a metal tower or mast pole, on which the elementary driven antenna elements are supported, will generally be made with a relatively large diameter. That is, the supporting structure will generally have a major transverse dimension greater than one-quarter wavelength, at the transmitted frequency, to provide the strength and rigidity necessary to mechanically support the antenna assembly and maintain stability in the wind and weather conditions to which it may be subjected. However, a relatively large diameter supporting structure, (e.g., of about a quarter wavelength or greater) generally produces a so-called "shadowing" effect on the resulting antenna pattern, and due to this effect a simple, single vertical array of driven antenna elements on such a supporting structure will not ordinarily provide the omnidirectional, or other desired shaped pattern required for a particular broadcasting application.

In U.S. Pat. Nos. 3,587,108 and 3,821,745, of the present inventor, there is disclosed and claimed an antenna assembly structure for achieving an omnidirectional or other desired pattern with a single vertical linear array of elementary antennas mounted on a large diameter structure of any conventional construction, wherein the assembly generally comprises the supporting structure, a driven antenna carried by the supporting structure and defining a radiation axis extending therefrom, and at least one end-fire parasitic director carried by the supporting structure. The end-fire parasitic director, in accordance with preferred embodiments of those patents, has a longitudinal axis and comprises discrete conductive plates disposed in spaced relation along that axis. The discrete conductive plates have their respective major dimensions at least a quarter-wavelength in the plane of the electric field vector of the transmitted signal, and each director is positioned relative to the driven antenna and supporting structure so as to alter the shape of the antenna pattern produced by their combined effects to provide the selected overall antenna pattern for the assembly. One or more of such parasitic directors may be employed, as desired, in combination with the supporting structure and driven elements to produce any number of pattern shapes, from omnidirectional to highly directional, and these are described in detail in the aforementioned patents.

Because of the high gain, and consequent great height, requirements of such antenna assemblies, it is often necessary, as previously indicated, to make the transverse dimension of the support structure, such as the diameter of a supporting mast or pipe, or the equivalent dimension of triangular or other shaped towers, not only greater than a quarter wavelength, but at least one-half wavelength or more. And in particular, it should be noted here that although omnidirectional performance is the most common requirement for broadcast antenna designs, it is generally the most difficult criterion to meet. Antennas requiring directive performance are almost always easier to design. Thus, omnidirectional performance is typically the governing design criterion, and because of shadowing effects, the principal controlling parameter is the support mast size (in wavelengths), regardless of the number of plates employed. The employment of large numbers of plates per director and the potential need for more than two directors per bay considerably worsen the problems of supporting the directors and the problems associated with wind load, in addition to increasing the cost of the antenna assembly.

Accordingly, it is an object of the present invention to provide an improved antenna assembly which may employ a low cost, conventional supporting structure, and which obviates or minimizes the aforementioned problems while maintaining a high gain, omnidirectional or other desired antenna pattern using a linear row of driven elements with one per bay required, even for supporting structures having extremely large transverse dimensions.

In practice, conventional steel pipe is commonly employed for the supporting mast since it is relatively inexpensive and can be flanged with standard flanges, whereas "high strength" steels cannot. Consequently, from practical design considerations, such mast pipes for UHF broadcasting, for example, are commonly required to have diameters of from one-half to three-quarter wavelength, based on existing transmitter tube powers, FCC rules on effective radiated power (ERP), yield strengths of the steel, considerations regarding the power handling characteristics of the coaxial feed lines located inside the pipe, etc.

Although with mast structures of less than one-half wavelength diameter, it may be practical in many antenna designs according to the teachings of the aforementioned patents to use only two plates per end-fire director to achieve an omnidirectional pattern, for mast structures having diameters larger than one-half wavelength a greater number of plates per director is generally required to maintain the same omnidirectional performance. However, it has been found that as the mast diameter is increased, which generally increases the required number of plates per director, undesirably sharp lobes and nulls tend to be formed in the antenna pattern. This increases the criticality of the director positions, and in some cases, requires the use of additional end-fire directors for pattern smoothing. In certain cases the 3db omnidirectional pattern tolerance may not be possible to attain at all with only two end-fire directors per bay.

I have discovered that a similar or superior result can be obtained by replacing the parasitic directors by metal fins attached to the support structure, or forward of the driven element, or both. Using this technique omnidirectional performance within ± 1.5 db has been obtained on supports up to ¾ wavelength diameter and directive patterns of many shapes have also been obtained. This structure is much more sound structurally than one using parasitic directors, presents such less wind load, is less affected by mutual coupling among bays, and by effects of supporting members which parasitic directors required. Further, the fins protrude less than the prior art parasitic directors from the supporting pipe and accordingly interfere less with climbing, and are less subject to the effects of wind, ice and dirt. The antenna of this invention is more broadband, that is to say, it has greater bandwidth for a given input VSWR limitation.

The antenna of this invention utilizes a plurality of generally radially extending fins acting as a surface wave carrier, bringing the energy around the surface of the pipe to fill in, partially or completely as desired, the normal shadow caused by the pipe supporting structure on the pattern of the driven element.

These and other objects, feature and advantages of the invention, will, in part, be pointed out with particularity, and will, in part, become obvious from the following more detailed description of the invention, taken in conjunction with the accompanying drawings which form an integral part thereof.

DESCRIPTION OF THE EMBODIMENTS

Figure 1:
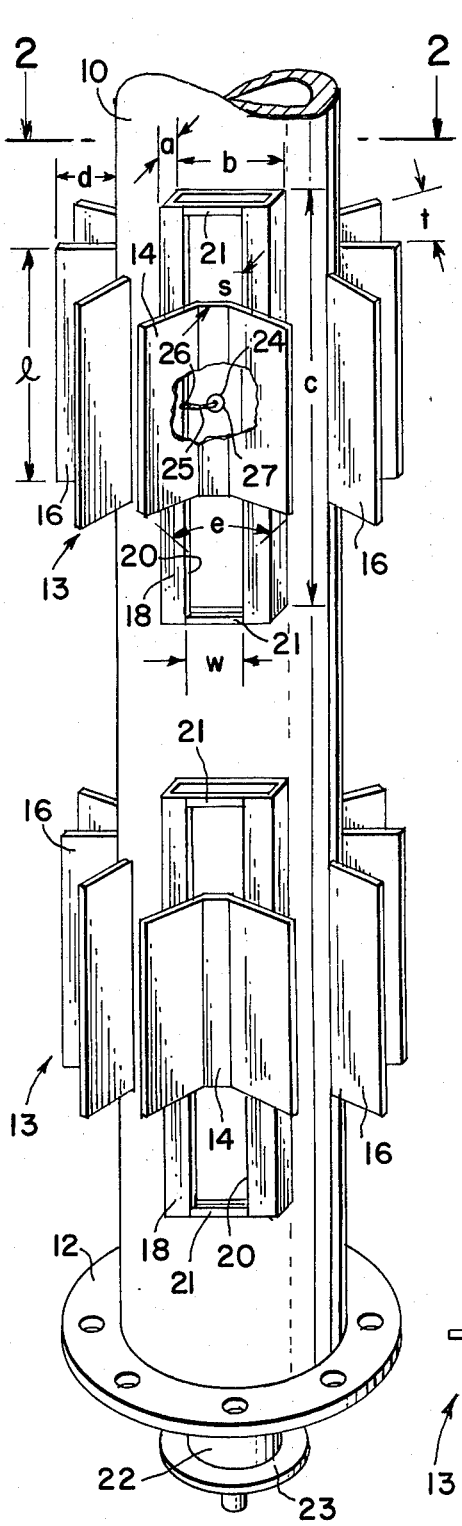
FIG. 1 is a perspective showing of two representative bays of one embodiment of the antenna of this invention with a portion of a forward fin partially broken away.

In FIG. 1 there is shown a section of a support pipe 10 provided with a welded flange 12 for attachment of the pipe to a supporting tower (not shown). Typically a steel pipe is used which is from 4 to 16 inches in diameter which is generally in the range of 0.25 to 0.75 wavelength at the frequency of interest.

The pipe carries a number of antenna bay 13, each bay comprising an elementary driven antenna and either a forward fin 14, a plurality of radially extending rearward fins 16 deployed substantially radially around the periphery of the pipe or a combination of forward and rearward fins.

In this specification the term "rearward fins" refers to fins on the support side of the slot or other elementary antenna and the term "forward fin" refers to fins in front of the slot.

The antenna operates as a surface wave antenna directing energy to the rear (i.e. support structure) area and filling in the rear shadow region caused by the support (pipe), thereby fulfilling the same function as the prior art parasitic directors. The forward fins 14, when used, aid in directing additional energy toward the rearward fins 16 to further assist in filling the rear shadow or other rearward areas.

The presently preferred elementary driven antenna is a slot herein shown as a closed ended cavity 18 having a slot 20 whose electrical length C is determined by the position of shorting bars 21. The slot 20 is fed by a coaxial line 22 shown with a coupling flange 23 for connection to a transmission line (not shown) leading from the transmitter. The coaxial line 22 is coupled by coaxial line branch connection 24 which are connected across the slot, the center conductor 25 terminates at one side of the slot at 26, the outer conductor may end at the cavity at 27.

Typical Dimensions are:

$a$ = Cavity depth = 0.06 to 0.5 wavelength
$b$ = Cavity width = 0.12 to 0.8 wavelength
$c$ = Cavity length = 0.5 to 1 wavelength
$d$ = Depth of rearward fin = 0.1 to 0.3 wavelength
$l$ = Length of fins = 0.12 to 1.0 wavelength
$e$ = Overall width of forward fin = 0.2 to 0.9 wavelength
$s$ = Distance from front of slot to forward reflector = less than 0.5 wavelength
$t$ = Space between fins = 0.1 to 0.5 wavelength
$w$ = The width of slot opening = 0.12 to 0.5 wavelength Narrow metal extensions directly (180°) behind the slot would have no affect on the pattern, and climbing steps 19 may be located in this area.

Figure 3:
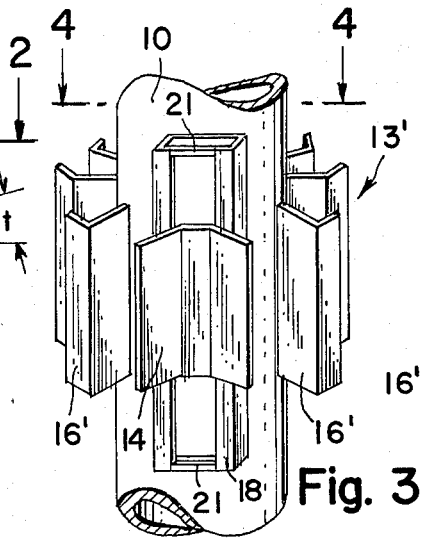
FIG. 3 is a perspective showing of a representative section of a supporting pipe with a typical bay showing an alternative fin embodiment of this invention.
Figure 4:
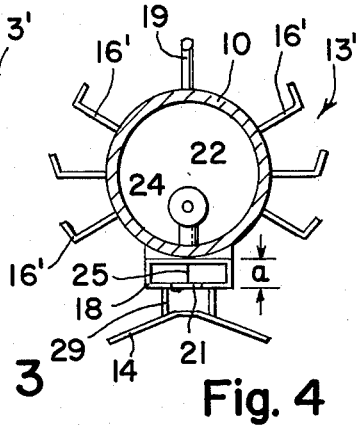
FIG. 4 is a sectional view taken along line 4—4 of FIG. 3.

As shown in FIGS. 3 and 4, the fins need not be straight but may be bent. In this case, the dimension d would be the overall depth of the fin and should be in the range of 0.1 to 0.3 wavelength.

Figure 5:
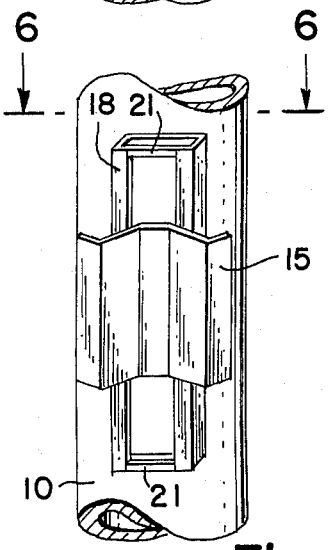
FIG. 5 is a perspective showing of a representative section of a supporting pipe with a typical slot bay employing a forward fin.
Figure 6:
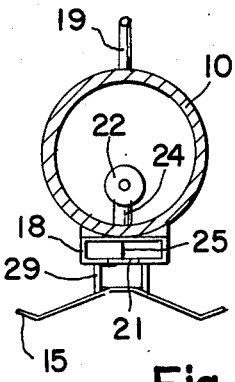
FIG. 6 is a section taken along line 6—6 of FIG. 5.
Figure 2:
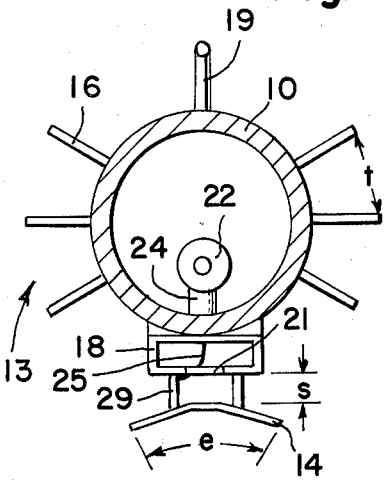
FIG. 2 is a sectional view taken along line 2—2 of FIG. 1.

While the rearward fins have been found to improve the omnidirectionality of the pattern, it has been found that even a single forward fin 15 of the proper shape as shown for example in FIGS. 5 and 6 is useful, as long as the overall transverse dimension of the forward fin is between 0.025 and 1.0 wavelength and the distances from the slot center to the fin is less than 0.5 wavelength in a plane normal to the slot. The forward fin is shown supported by dielectric supports 29.

Figure 7:
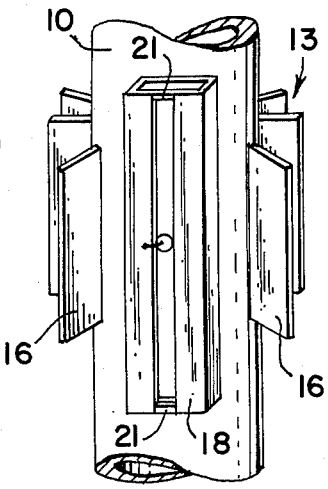
FIG. 7 is a perspective showing of a pipe section with a conventional slot and the radial rearward fins of this invention.

While the forward fin is desirable, it has been found that the antenna can also be operated without it and still achieve omnidirectional or other desired performance as is shown in FIG. 7 where a conventional slot antenna is used in combination with only the rearward fins of this invention.

Figure 8:
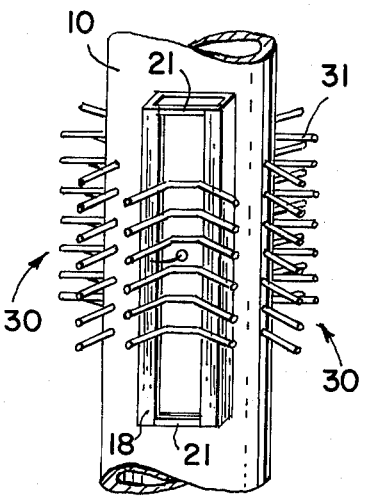
FIG. 8 is a perspective showing of a pipe section with a single bay employing horizontal bar fins.
Figure 9A:
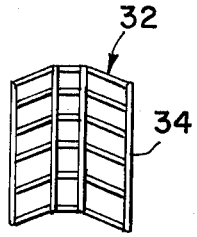
FIG. 9*a* is a perspective showing of a closed bar forward fin.
Figure 9B:
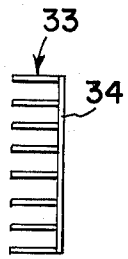
FIG. 9*b* is a perspective showing of a closed end bar rearward fin.

The fins may take many forms structurally. Thus, in FIG. 8, the fins 30 are shown constructed of a series of metal bars 31 generally radial to the support. While in FIGS. 9*a* and 9*b* there is shown a forward fin 32 and typical rearward fin 33 respectively of similar construction with the ends of the bars tied together by conductive or non-conductive strips 34.

Figure 12:
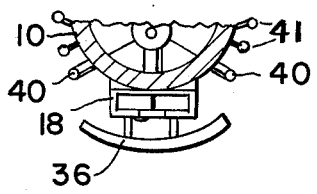
FIG. 12 is a section taken along lines 12—12 of FIG. 11.
Figure 10:
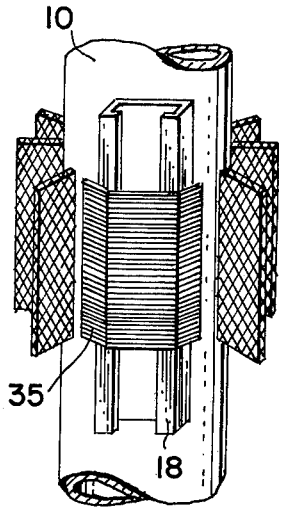
FIG. 10 is a perspective showing of a pipe section carrying a slot, a forward and a plurality of rearward fins.
Figure 11:
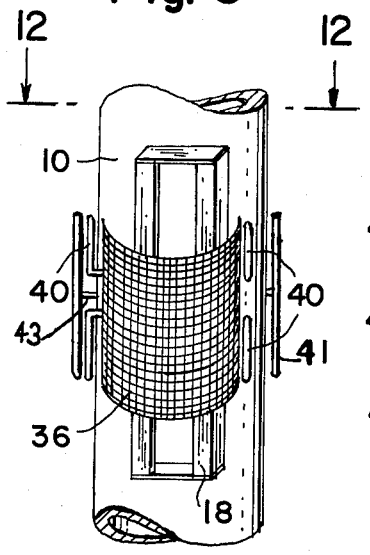
FIG. 11 is a perspective showing of a pipe section carrying a slot antenna with a forward fin and a pair of dipole antennas.

In FIGS. 10, 11 and 12, the forward fins 35 and 36 respectively are shown bent substantially concentric with the supporting pipe. In FIG. 12, the rearward fins have been omitted. Whereas in FIG. 10, the forward fin is shown as a series of horizontal rods, and the rearward fins as mesh, in FIG. 12, it is shown formed as a mesh of horizontal and vertical rods.

The slot may be open or closed at the ends. By way of example, the slot is shown closed in FIG. 8, whereas in FIG. 10 it is shown open.

For addition of vertical polarization a dipole feed 40 may be added as shown in FIG. 12. This vertical polarization feed may be combined with the horizontal polarization provided by the slot in order to produce circular polarization or other composite polarization of the wave.

Figure 13:
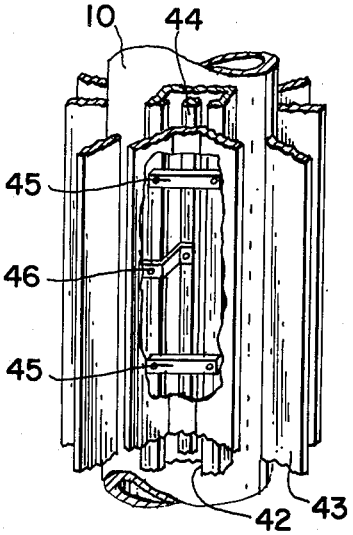
FIG. 13 is a perspective view of a section of a continuous slot and fin antenna.

In FIG. 13, there is shown a continuous slot 42 and fin 43 arrangement utilizing a common strip line or bar 44 feed to all the slots. Each slot being electrically isolated from the other by shorting bars 45. Strap 46 connects the strip line to the cavity and excites the slot.

Figure 14:
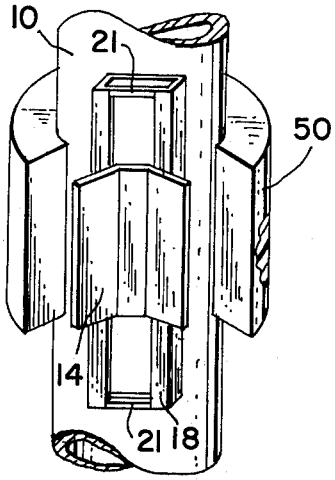
FIG. 14 is a perspective view of a section of a supporting pipe with a single bay of a slot antenna with a forward fin and a dielectric rearward fin, with a portion of the dielectric shown broken away.

FIG. 14 discloses a dielectric wedge 50, which may be formed, for example, of a synthetic resin such as methyl methacrylate, fitting coaxially around the pipe and which acts like the fins. The use of the forward fin is optional as explained hereinabove. The thickness of the dielectric shall be between 0.2 and 0.9 wavelength in the dielectric at the frequency of interest.

Figure 15:
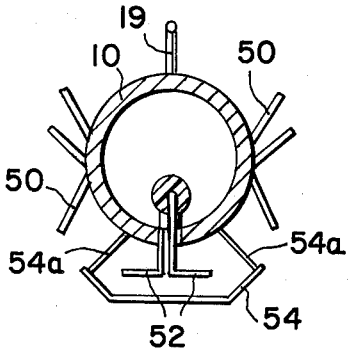
FIG. 15 is a plan view, in section of a pipe support with a dipole elemental antenna, forward fin and a plurality of rearward fins.
Figure 16:
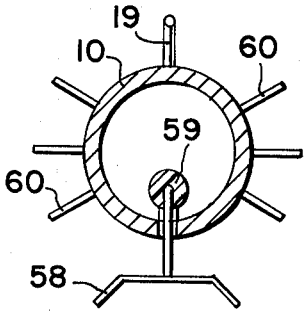
FIG. 16 is a plan view, in section of a pipe support of an alternative antenna with a forward fin and a plurality of rearward fins.

In FIG. 15 there is shown a series of rearward fins 50 and a forward fin 54 supported by dielectric arms 54*a*. In this instance the elementary driven antenna is a dipole antenna 52. The fins are intentionally shown not extending radially. To illustrate that, it is not essential that they extend radially.

Still another form of elementary driven antenna utilizes a forward fin 58 coupled to the coaxial feedline 59 with rearward fins 60.

Figure 17:
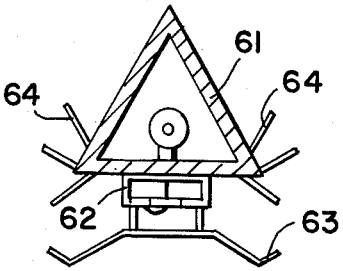
FIG. 17 is a plan view, in section of a triangular tower showing a slot antenna, forward fin and rearward fins.

In FIG. 17 a mesh covered triangular tower 61 is fitted with a slot antenna 62 and forward fin 63 and rearward fins 64 near the corners adjacent to the slot.

Figure 18:
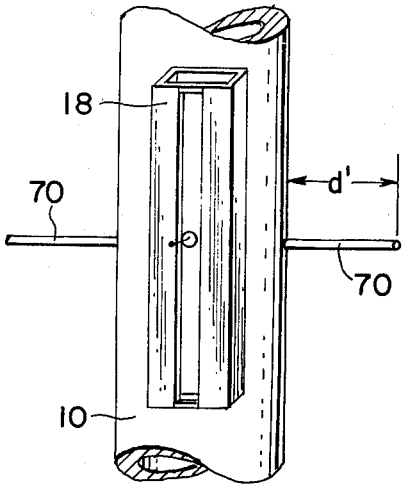
FIGS. 18–21 are perspective views of supporting members with alternative embodiments of the invention.

As shown in FIG. 18, the fin may take the form of a thin electrically conductive rod 70 having a length $d'$ in the range 0.1 to 0.3 wavelength. The rod is in electrical contact with the supporting pipe to take advantage of the mirror image effect.

Figure 19:
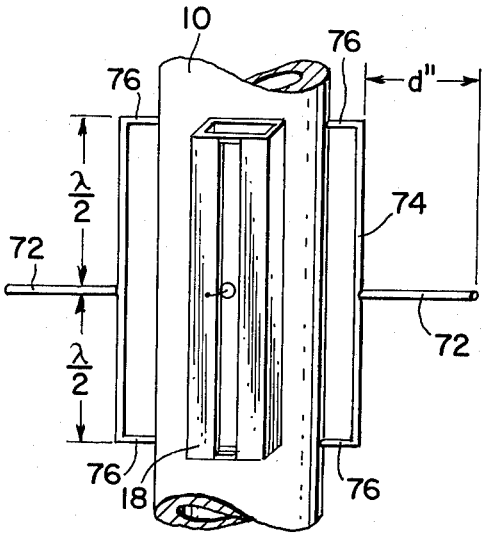
Figure 20:
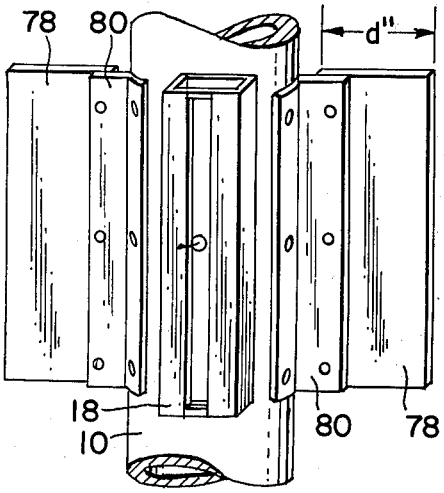
Figure 21:
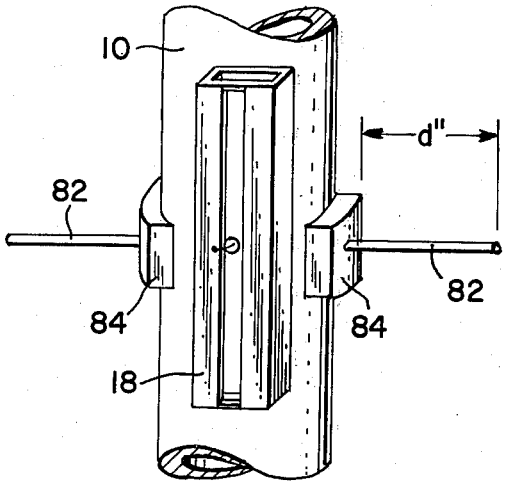

As shown in FIGS. 19, 20 and 21 the fins may be electrically isolated from the electrically conductive supporting pipe. In this situation the fins should have a length $d'$ from about 0.2 to 0.6 wavelength. In FIG. 19 the fin 72 is supported by a bracket 74 having horizontal portions 76 from about 0.05 to approximately 0.25 wavelength long positioned about a half wavelength apart with the fin 72 extending from the midpoint. The arms 76 are located near the end of the slot.

In FIG. 20 an elongated metal fin 78 having a length $d''$ from 0.2 to 0.6 wavelengths is shown supported by a dielectric support 80. Similarly in FIG. 21 a simple metal rod 82 having a length $d'' = 0.2$ to 0.6 wavelength is supported by an insulator 84 spacing the fin from the support sufficient to prevent contact to about one-fourth wavelength.

As shown in FIGS. 11 and 12 the dipole is provided with one or more vertical fins 41 0.2 to 0.6 wavelength long. The fins are spaced from the support pipe by an insulator 43. These vertical fins perform the identical function as the horizontal fins 31, 70 and 82 for example, that is control of the horizontal pattern by reducing the shadow of the support member. However, they operate with a vertically polarized exciting antenna such as a dipole parallel to the support axis.

Instead of using a dipole for polarization parallel to the support axis and a slot for polarization normal thereto, other exciters and exciter combinations may be used such as dipoles at e.g. 45° to the axis, or crossed dipoles at e.g. ± 45° associated with both vertical and horizontal fins, each controlling the pattern for the corresponding polarization component. In any of these ways other polarizations, such as circular, may be obtained, depending on such things as relative amplitude and phase of feeding of slot and dipole, or orthogonal dipoles, at each bay level.

Vertical dipoles, i.e. parallel to the support axis may also be located at other points than shown in FIGS. 11 and 12, e.g. diametrically opposite a slot, at which location there will be negligible interaction between the slots and dipoles, allowing simple control of each pattern component separately with appropriate vertical and horizontal fins generally at right angles to each other and, for example, separately insulated from each other and from the supports and exciters and in the form of simple rods.

Any exciting antenna type chosen may utilize strip line feed techniques, and in fact the orthogonal dipole exciter may use a single strip and also achieve circular polarization by feeding the clockwise 45° dipole ⅛ wavelength below the bay center and the counterclockwise 45° dipole ⅛ wavelength above, creating a 90° differential phase with equal amplitude and therefore circular polarization. The same fins serve both dipoles in such a set, e.g. horizontal rod fins for the horizontal electrical component and separate vertical rod fins dielectric supported for the vertical electric component of the radiation from each dipole.

There has been disclosed heretofore the best embodiments of the invention presently contemplated. However, it is to be understood that various changes and modifications may be made thereto without departing from the spirit of the invention.

What I claim as new and desire to secure by Letters Patent is:

1. An antenna assembly for transmitting signals of a given wavelength comprising:

a. an electrically conductive supporting structure extending along a longitudinal axis and having a major transverse dimension such as to affect the pattern of a signal transmitted by the antenna assembly;

b. a driven antenna element carried by said supporting structure;

c. a longitudinally extending forward reflecting fin of a generally rectangular outline having a longitudinal dimension between 0.12 λ and 1.0 λ and a transverse dimension between 0.2 λ and 0.9 λ positioned less than 0.5 wavelength in front of said driven antenna element on the side thereof opposite the said supporting structure for rearwardly directing at least a portion of the energy radiated by said driven element; and d. at least one elongated electrically conductive rearward slow wave propagating device radially extending from said supporting structure and in electrical contact therewith throughout its length arranged to receive a portion of the energy directed by said longitudinally extending reflecting fin.

2. The antenna assembly of claim 1 including a plurality of said slow wave propagating devices.

3. The antenna assembly of claim 1 including a plurality of radially extending electrically conductive fins, said fins having an outward edge in the range of 0.1 to 0.3 wavelength from said supporting member and a length in the range of 0.12 to 1 wavelength.

4. The antenna assembly of claim 3 wherein said plurality of fins are spaced from 0.1 to 0.5 wavelength apart at their outer edges.

5. The antenna assembly of claim 4 wherein said fins have first and second planar portions intersecting along a line parallel to the longitudinal axis of said supporting structure.

6. The antenna assembly of claim 1 wherein said forward fin terminates in planar portions directed rearwardly toward said supporting member.

7. The antenna assembly of claim 1 wherein said forward fin comprises rods.

8. The antenna assembly of claim 1 wherein said forward fin comprises a mesh.

9. The antenna assembly of claim 1 wherein said forward fin comprises rods terminating in a vertical conductive member.

10. The antenna assembly of claim 1 wherein said rearward fin comprises rods.

11. The antenna assembly of claim 1 wherein said rearward fin comprises a mesh.

12. The antenna assembly of claim 1 wherein said rearward fin comprises rods terminating in a vertical conductive member.

13. The apparatus of claim 1 having a plurality of said driven antenna elements.

* * * * *